US010450998B2

(12) United States Patent
Rasmussen

(10) Patent No.: US 10,450,998 B2
(45) Date of Patent: Oct. 22, 2019

(54) ONE PIECE CAST FERROUS CROWN PISTON FOR INTERNAL COMBUSTION ENGINE

(71) Applicant: Industrial Parts Depot, LLC, Torrance, CA (US)

(72) Inventor: Robert Rasmussen, Henderson, NV (US)

(73) Assignee: INDUSTRIAL PARTS DEPOT, LLC, Torrance, CA (US)

( * ) Notice: Subject to any disclaimer, the term of this patent is extended or adjusted under 35 U.S.C. 154(b) by 1 day.

(21) Appl. No.: 15/595,509

(22) Filed: May 15, 2017

(65) Prior Publication Data

US 2017/0314503 A1 Nov. 2, 2017

Related U.S. Application Data

(63) Continuation-in-part of application No. 13/098,725, filed on May 2, 2011, now abandoned, which is a continuation of application No. 11/804,504, filed on May 18, 2007, now abandoned, which is a continuation-in-part of application No. 10/973,006, filed on Oct. 25, 2004, now abandoned.

(51) Int. Cl.
*F02F 3/22* (2006.01)
*F02F 3/00* (2006.01)

(52) U.S. Cl.
CPC ..... *F02F 3/0084* (2013.01); *F02F 3/0069* (2013.01); *F02F 3/22* (2013.01); *F02F 2003/0007* (2013.01)

(58) Field of Classification Search
CPC ..... F02F 3/0084; F02F 3/0069; F02F 3/22; F02F 2003/0007
USPC ..... 123/193.6, 197.2
See application file for complete search history.

(56) References Cited

U.S. PATENT DOCUMENTS 4,864,986 A * 9/1989 Bethel ..... F02F 1/183 123/193.6
4,903,580 A * 2/1990 Bruni ..... F02F 3/022 123/193.6
4,989,559 A * 2/1991 Fletcher-Jones ..... F02F 3/0076 123/193.6
5,211,101 A * 5/1993 Letsch ..... F02F 3/0069 92/177
5,299,490 A * 4/1994 Harrer ..... F02F 3/02 123/193.6
5,404,792 A * 4/1995 Watanabe ..... F02F 3/00 123/193.6
5,544,627 A * 8/1996 Terziev ..... F02F 7/0019 123/197.3
6,189,500 B1 * 2/2001 Gyllenstedt ..... F02F 3/022 123/193.6
6,202,619 B1 * 3/2001 Keller ..... F02F 3/22 123/193.6

(Continued)

*Primary Examiner* — Marguerite J McMahon
(74) *Attorney, Agent, or Firm* — Wegman, Hessler

(57) ABSTRACT

A one-piece piston having an investment or other permanent or non-permanent mold/die precision cast piston crown, rod flange and piston skirt. The piston crown has a relative constant thickness, a flange requiring minimal machining and a skirt providing for a wall with a support against the angular shifting of the piston. This improves the distribution of heat within such crown and the angular stability of the piston wall at the piston rod connection.

14 Claims, 9 Drawing Sheets

(56) References Cited

U.S. PATENT DOCUMENTS

| | | | | |
|---|---|---|---|---|
| 7,383,807 | B2 * | 6/2008 | Azevedo | F02F 3/0084<br>123/193.6 |
| 2011/0023706 | A1 * | 2/2011 | Pegg | F02F 3/027<br>92/159 |

* cited by examiner

ONE PIECE CAST FERROUS CROWN PISTON FOR INTERNAL COMBUSTION ENGINE

REFERENCE TO THE RELATED APPLICATION

This application is a Continuation-In-Part of and incorporates by reference U.S. patent application Ser. No. 13/098,725 entitled "ONE PIECE CAST FERROUS CROWN PISTON FOR INTERNAL COMBUSTION ENGINE" filed May 2, 2011. This application also claims the priority benefit of U.S. patent application Ser. No. 11/804,504 filed May 18, 2007 and U.S. patent application Ser. No. 10/973,006 filed Oct. 25, 2004.

BACKGROUND OF THE DISCLOSURE

Field of the Disclosure

This disclosure relates to a one piece piston which incorporates a high strength cast ferrous crown having a constant wall thickness together with an integral machined piston skirt attached to the piston/connecting rod with a wrist pin.

Description of Related Art

Internal combustion (IC) engines have been utilized for years in stationary and mobile applications. Examples of the former include pumps, generators, oil field equipment, compressors, and the like, while examples of the latter include heavy tractors, trucks, earthmoving equipment, automobiles, marine propulsion and auxiliary uses and the like.

Recent developments to the numerous types of IC engines in the last fifteen years have demonstrated that in the diesel engine and high power gaseous fueled applications of such engines, substantial thermal efficiencies, increases in power as a ratio of engine displacement, and reductions in emission can be achieved by increasing the combustion pressure and in the case of the diesel engine, the fuel injection pressures.

These increases in mechanical and thermal efficiency have been achieved through increasing intake air pressure by a factor of several magnitudes of atmospheric pressure by the utilization of mechanical and/or turbo supercharging, by increasing diesel fuel injection pressure and with precision mechanical and/or electronic means of controlling the operation and thermal condition of the subject IC engine by the use of electronic engine management systems.

These developments have all resulted in an increase in the temperature of the combustion process in both the diesel and gaseous fuel iterations of the IC engine which has manifested itself in the form of piston top (crown) temperatures that exceed the thermal limits of known materials and applications.

Known methods of cooling such pistons by use of oil jets from beneath and temporary retention and heat rejection by captured oil delivered by such means have failed to solve the problems satisfactorily in most applications.

The makers of IC engines and parts have further sought many avenues of materials and design to solve the dual problems of material strength at elevated temperatures and acceptable material weight.

This concurrent need for thermal strength and acceptable weight is the result of the piston in an IC engine being a moving, in fact, reciprocating part that moves through the piston bore of such engines at high linear speeds in order to translate combustion pressure on the piston through connecting rod into rotational energy at the crankshaft.

In addition, the piston in its cylindrical bore has been traditionally and remains sealed between the combustion part located between the top of the moving piston and the cylinder top or head and the remainder of the engine by a multiplicity of sealing rings that are installed in circumferential groove machined into the outer diameter of the piston itself, each ring being in the form generally of a rectangular cross section that is radially cut to permit its elongation and installation in the groove in the piston.

In the most recent development of IC technology it has further been proven that the closer that the top most of the aforementioned sealing rings can be installed to the top of the piston itself, the less stagnant or residual gasses remaining from the preceding combustion event will be present and the amount of certain undesirable combustion by products including but not limited to oxides of nitrogen and monoxides of carbon will be substantially minimized by the engine in its operation.

This desire to particularly locate the topmost piston ring has by itself posed unique material and design problems that have not been satisfactorily addressed in a cost effective manner by existing designs and iterations of piston technology.

Although there have been numerous methods applied by the makers of engines and pistons to solve these multiple objectives (high strength, thermal stability, ring groove stability, production costs) none have been entirely satisfactory from either a weight or strength standpoint, or alternatively, if such a design and operational balance is approached, it is by methods and designs that are substantially more costly to produce that the prior common aluminum IC piston that has been the standard for over 60 years.

In this search for acceptable dual qualities of thermal strength and acceptable component weight, among the methods used are the following, each with its unsatisfactory characteristics noted:

1. High strength aluminum pistons:

Heat resistant alloys are costly and difficult to forge or cast, will not withstand combustion pressures and temperatures at existing engine power levels, and prematurely fail in service;

2. Cast or forged aluminum or aluminum alloy pistons with cast in place ferrous inserts for ring grooves and piston tops/combustion cavities:

Costly to manufacture and at high temperatures the remaining aluminum eventually erodes or loses necessary thermal strength;

3. One piece cast iron pistons that mimic aluminum designs:

Heavy weight and inconsistent expansion/thermal characteristics limit applications and combustion pressures due to poor weight strength ratio;

4. Two piece pistons with forged and machined ferrous crowns connected to cast/forged and machined aluminum skirts by the use of high strength elongated gudgeon/wrist pins:

Very high cost to manufacture piston crowns and skirts in separate steps;

Substantially heavier that one piece design and requires heavier rotating assembly to accommodate and compensate;

5. Forged and machined ferrous piston crowns that are joined by mechanical means or friction welding to ferrous or non-ferrous skirts with a common piston/gudgeon pin:

Very costly to manufacture, compromised thermal characteristics and unsatisfactory in long term service;

6. Forged and machined one piece ferrous skeleton piston:

Very costly to manufacture from a forging to achieve the requisite constant and controlled cross section of the crown and skirt, requires extensive and costly machining processes.

In addition, since these pistons, of whatever design, do wear in service, particularly in comparison to the life of the entire engine where pistons may be replaced five or ten times in a typical engine's installed service life; thus for this reason, a substantial market has developed for pistons utilized both in the initial, typically name brand, production of the engines as well as in the aftermarket repair and rebuilding of the engines.

In consideration of the above, piston manufacturers are constantly developing new technology relative to existing designs in a search for longevity of initially installed pistons as well as those used in the rebuilt/remanufactured processes in order to lengthen the service life of a particular engine block.

The purpose of these various engine and piston designs is said to provide increased thermal equalization, mechanical stability, and longer service life. While they may do so, the cost of the tooling and manufacturing processes is significant, and the secondary machining operations are numerous, complicated, and costly; finally not always resulting in acceptable in service life or desired engine performance characteristics.

BRIEF SUMMARY

In one aspect of the present disclosure, a piston is designed for reciprocatable movement within a combustion chamber of an internal combustion engine. The piston includes a piston crown with an integrally cast piston skirt comprising two equal and opposing arcuate surfaces. Each of the surfaces comprises an arc of less than 180 degrees with the centerline of each arcuate section perpendicular to the axis of the connecting rod connecting pin bore. The piston also includes two integrally cast connecting rod connecting flanges. The piston is precision cast of high-strength ferrous material net to finished dimensions on all inner and outer surfaces to provide a defined thickness throughout to ensure mechanical and thermal consistency with only secondary finishing of an outer cylindrical surface of the crown, outer edges of the connecting rod flanges, two connecting rod bearing surfaces, and a top surface of the crown. The piston eliminates machining operations necessary to achieve constant and correct cross sectional dimensions of the crown and the piston skirts. The piston further includes a cooling oil dam that is positioned adjacent a lower edge of the crown and attachable to the crown by an interference fit. Each operative part of the crown includes a substantially constant thickness throughout as initially precision cast to net finished dimensions. A portion of the piston defines at least one multi-arcuate horizontal cross-section, wherein the multi-arcuate horizontal cross-section includes arcs including different radii. The crown defines a ring groove and an oil groove on an exterior surface.

In another aspect of the present disclosure, a piston designed for reciprocatable movement within a combustion chamber of an internal combustion engine includes a piston crown with an integrally cast piston skirt. The piston skirt includes two equal and opposing arcuate surfaces each of which comprises an arc of less than 180 degrees with the centerline of each arcuate section perpendicular to the axis of the connecting rod connecting pin bore. The piston also includes two integrally cast connecting rod connecting flanges extending between the arcuate sections. Each part of the piston is precision cast of high-strength ferrous material net to finished dimensions on all inner and outer surfaces. The precision casting provides a defined thickness throughout to ensure mechanical and thermal consistency. The piston requires only secondary finishing of an outer cylindrical surface of the crown, outer edges of the rod connecting flanges, a rod connection bearing seat, and a top surface of the crown while eliminating machining operations necessary to achieve constant and correct cross sectional dimensions of the crown and the piston skirt. Each operative part of the crown includes a substantially constant thickness throughout as initially precision cast to net finished dimensions. A portion of the piston defines at least one multi-arcuate horizontal cross-section, wherein the multi-arcuate horizontal cross-section includes arcs including different radii. The piston skirt is configured to ensure consistent contact with the cooperating cylinder wall surfaces.

In yet another aspect of the present disclosure, a piston designed for reciprocatable movement within a combustion chamber of an internal combustion engine includes a piston crown with an integrally cast piston skirt. The piston also includes two rod connecting flanges. The piston is precision cast of high-strength ferrous material net to finished dimensions on all inner and outer surfaces to provide a defined thickness throughout to ensure mechanical and thermal consistency. The piston requires only secondary finishing of an outer cylindrical surface of the crown, outer edges of the rod connecting flanges, a rod connection bearing seat, and a top surface of the crown, while eliminating machining operations necessary to achieve constant and correct cross sectional dimensions of the crown and the piston skirt. Each of the rod connecting flanges includes a center opening formed therethrough to provide a contact surface that is generally cylindrical. The surface area of an upper half of the contact surface that is closer to the crown is greater than the surface area of a lower half of the contact surface that is farther from the crown. A portion of the piston defines at least one multi-arcuate horizontal cross-section, wherein the multi-arcuate horizontal cross-section includes arcs including different radii. Each operative part of the crown comprises a substantially constant defined thickness throughout as initially precision cast to net finished dimensions.

These and other features and advantages of this disclosure are described in, or are apparent from, the following detailed description of various exemplary embodiments of the systems and methods according to this disclosure.

BRIEF DESCRIPTION OF THE DRAWINGS

The above mentioned and other features of this disclosure will become more apparent and the disclosure itself will be better understood by reference to the following description of embodiments of the disclosure taken in conjunction with the accompanying drawings, wherein.

Corresponding reference characters indicate corresponding parts throughout the views of the drawings.

DETAILED DESCRIPTION

Figure 1:
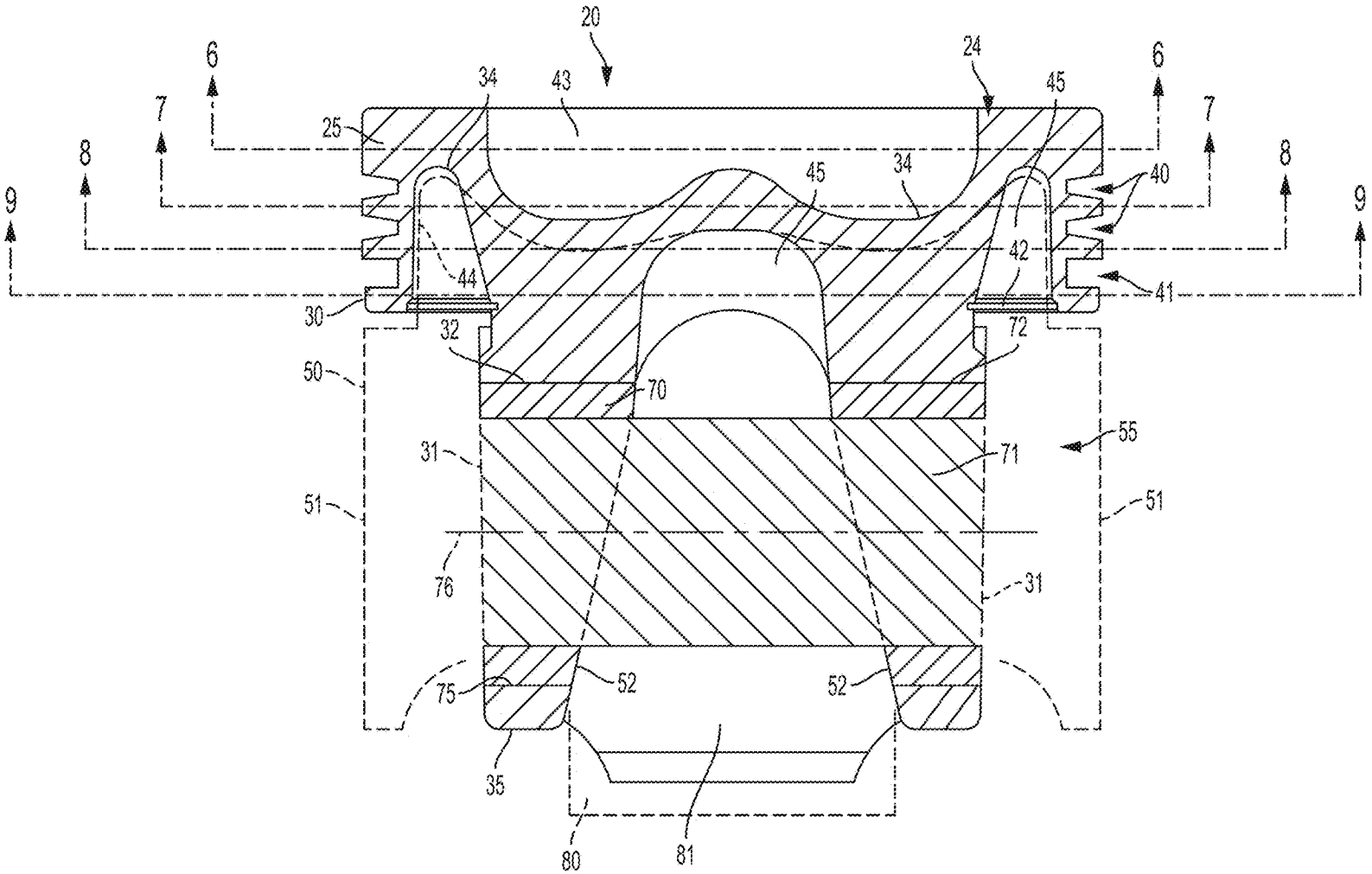
FIG. 1 is a view of a piston incorporating the present disclosure taken substantially along lines 1-1 in FIG. 4.
Figure 2:
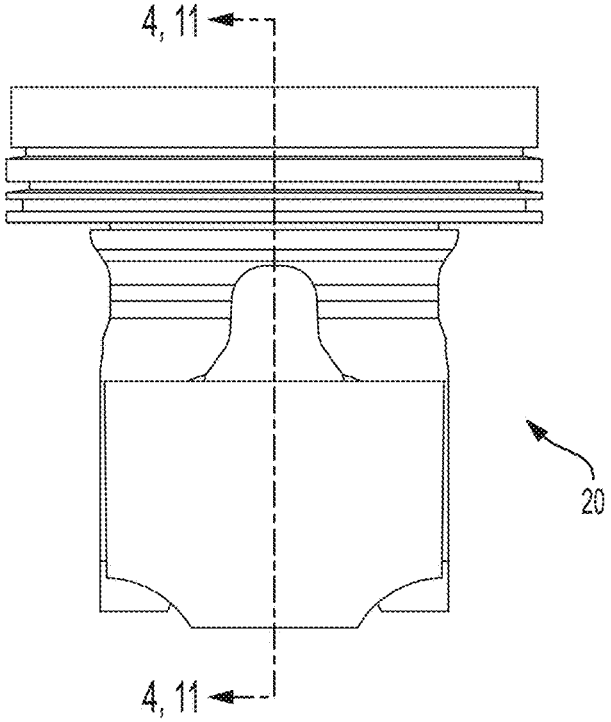
FIG. 2 is a side view of the piston of FIG. 1.

The disclosure will now be described in the following detailed description with reference to the drawings, wherein embodiments are described in detail to enable practice of the disclosure. Although the disclosure is described with reference to these specific embodiments, it will be understood that the disclosure is not limited to these embodiments. But to the contrary, the disclosure includes numerous alternatives, modifications and equivalents as will become apparent from consideration of the following detailed description.

For example, the terms "higher," "up," "lower," "down," and "below" refer to directions relative to the central axis of a piston. The terms higher and up are intended to indicate a position on the piston closer to a crown of the piston. The terms lower, down, and below are intended to indicate a position closer to the opposite end of the piston from the crown. Additionally, the term "vertical cross section" indicates a cross section of the piston along a plane that is parallel or co-planar with the central axis of the piston. "Horizontal cross section" indicates a cross section of the piston along a plane that is transverse to the central axis of the piston. Still further, in the drawings, the same reference numerals are employed for designating the same elements.

Referring now to FIG. 1, the disclosure relates to a piston 20 for use in an internal combustion engine together with an investment cast method of manufacturing the piston. A typical example would be to utilize the piston 20 in an original manufacture or an after-market repair or remanufacture of a Detroit Diesel, Cummins, or Caterpillar diesel. The piston 20 itself in the shown embodiment is a one piece piston having a crown 25 and two opposing semi-circular arcuate piston skirts 51. The crown 25 is the main combustion chamber interactive part of the piston 20. This crown 25 is investment or other permanent or non-permanent mold/die precision cast. This provides for the creation of both internal and external surfaces of a complex part with dimensional stability in a single initial manufacturing step. The crown 25 is thus of substantially lighter weight than a typical forged or sand cast ferrous piston and amenable to a more complex design. This reduces the complexity and cost of the final secondary finish manufacturing. Further, the surface finish of the piston crown is relatively smooth and free of surface defects. The crown 25 can thus be investment or other permanent or non-permanent mold/die precision cast with minimal finish manufacturing tolerances (i.e., the crown is cast to zero net size finished or only minimally oversized—only that necessary to allow secondary finishing within a commercially acceptable range). This enables one to materially and substantially reduce the complexity of manufacturing of the piston 20 for internal combustion engines by casting them to dimensionally net shape and size and by therefore eliminating machining operations necessary to achieve constant and correct cross sectional dimensions of the crown and attendant skirt.

It is desirable to increase the service life of the piston 20 by manufacturing it from wear resistant ferrous materials that further remain dimensionally stable under conditions of high heat and pressure. In addition to the known and proven ferrous materials, and while the crown 25 shown is of steel alloy, it is possible to make the piston out of other metals that are subject to or adaptable to net dimensional casting methods which presently include investment casting, lost wax casting, lost foam casting, metallic and non-metallic permanent mold casting, and precision non-permanent mold casting.

This piston combining the use of net dimensional casting processes increases the adaptability of the piston to numerous applications with minimal additional tooling and/or material considerations. It is also noted that the weight reduction of the precision net dimensional cast piston is particularly important wherein the reduction of reciprocating mass increases both the efficiency and the service life longevity between repair and rebuilding operations thereof.

A pair of rod connection flanges 35 are investment or other permanent or non-permanent mold/died precision cast integrally with the crown 25 and a later described piston skirts 51 in the same casting operation. The rod connection flanges 35 of the piston 20 locates the piston skirts 51 relative to the crown 25. The rod connection flanges 35 thus cooperates with the later described piston skirts 51 to provide angular stability to the crown 25 with respect to the cylinder 100. This angular stability with a limited area about the circumference of the piston 20 aids in evening out any differential wear about the circumference of the piston 20. This evening out is especially true for forces perpendicular to the longitudinal axis 76 of a wrist pin 71.

This piston combining the use of net dimensional casting processes increases the adaptability of the piston 20 to numerous applications with minimal additional tooling and/or material considerations. It is also noted that the weight reduction of the precision net dimensional cast piston 20 is particularly important wherein the reduction of reciprocating mass increases both. The efficiency and the service life longevity between repair and rebuilding operations.

In addition, the balance or weight differential as manufactured between multiple pistons is reliable and predictable for economy in maintenance of inventory, replacement purposes, and the process of dynamically and statically balancing the reciprocating and rotating masses of an engine.

This secondary operation in the embodiment disclosed includes finishing the outer surface 30 of the crown 25 (in consideration of the diameter of the cylinder in the engine), and may include the outer edge 31 of the rod connection flanges 35 (in consideration of the inner dimension of the piston skirts 51), the bearing seat 32 (to match the outer diameter of the sleeve bearing 70), and the dimension of the top surface of the crown 25 (to match the bearing seat 32 to the head of the engine to provide the desired combustion ratio at top dead center piston location), or appropriately constructing the bearing seat 32 to cooperate with a tribological coating to form a bearing surface for the wrist pin 71. This further reduces the cost of the piston 20 significantly over alternative processes such as forging or conventional casting and subsequent machining.

Due to the use of a precision net to dimension casting, the crown 25 can be produced of a ferrous material with a thinner cross section, a more intricate shape, and with a higher initial tolerance than otherwise possible. Further, features as set forth are otherwise difficult or costly to machine can be included but are not limited to a cast in place dam of planar section at or near the inner diameter of the crown 25 for cooling oil retention, a separate metal plate so forming an oil retention dam fixed in similar place by (i) a circular spring ring, (ii) friction welding, (iii) interference fit, (iv) resistance or fill welding, (v) rotational locking, and (vi) adhesives and/or similar means.

The outer surface 30 of the crown 25 has ring grooves 40 is designed to cooperate with the piston rings (as shown in representational form in FIG. 12) and the inner wall of the cylinder liner 100 to define the lower extent of the combustion chamber. An oil groove 41 located below the rings on the upper surface 20 of the crown 25 reduces friction by providing for a lubricant flow at the critical location in the engine.

Due to the use of a net to dimension cast piston, the process finishing the outer surface 30 is significantly reduced from alternative manufacturing processes (such as the previously described forging). Typically, only a minor secondary operation is necessary in order to provide the finish dimensions for the outer surface 30 of the crown 25 due to the accuracy of the casting process, and then primarily to provide dimensional stability for the outer surface 30, the outer edge 31 of the bearing seat 32 and the top surface 24 of the crown 25. This equalizes any given piston to another so as to provide a more efficient and balanced engine and one where the uppermost ring groove is immediately adjacent to the top of the crown 25.

Further, the use of a net dimensional ferrous casting, the thickness of the crown 25 between the outer surface 30 and the lower confines of the swirl chamber 43 on top of the crown 25 and the inner surfaces 36 on the underside 45 of the crown 25 is of a predictable and substantially constant thickness throughout as initially cast (see dashed lines 44 in FIG. 1). This constant and predictable thickness allows for the efficient and consistent transfer of heat and reduction of heat distribution differences within the crown 25. This is in addition to the reduction of weight and reliability of weight balance due to the accuracy of initial casting of the piston 20.

Further, the auxiliary cooling oil, which is typically sprayed upward from a fixed location beneath the low travel extent of the piston 20, can penetrate further and more evenly within the crown 25 to provide for a more efficient and even heat removal from the piston rings 40 and the swirl chamber 43 at the top of the piston 20 by such cooling oil.

The seat 32 of the crown 25 is designed to retain the piston rod pin in a location relative to the piston (via sleeve bearing 70 in the embodiment shown) or designed as a direct connecting surface in cooperation with one or more tribological coatings applied to the seat 32 and/or the wrist pin 71. This serves as the main mechanical interconnection between the piston rod 80 and the piston 20. The seat 32 also cooperates with the wrist pin 71, the piston skirts 51 through the wrist pin 71 to provide angular stability of the crown 25 with respect to the cylinder 100. This evens out any differential wear about the circumference of the piston 20. This evening out is especially true for cocking forces about the longitudinal axis of the wrist pin 71 in both those applications where pin thrust offset is used as in other form engines and otherwise.

As this seat 32 is a circular hole extending straight through the rod connection flanges 35 of the crown 25, it is amenable to a simple finishing operation due to the accuracy of the initial casting process.

A sleeve bearing 70 is inserted through the rod connection flanges 35 in the crown 25 to the wrist pin 71 and thus the connecting rod 80. The use of an independent sleeve bearing 70 allows for the optimization of materials. This also allows the sleeve bearing 70 to be of a non-ferrous metal alloy or other material suitable to a moving, high force rotary interconnection while also allowing the crown 25 to be of a different material (a ferrous or ferrous alloy disclosed). Some examples of a different material can also include coatings comprising manganaese phosphate or diamond-like coatings.

The use of a separate sleeve bearing 70 also allows for the repair of this high stress area by the replacement of a relatively simple part instead of the entire piston, thus increasing the service life of the remainder of the piston 20. In another example, the mating surfaces between the sleeve bearing 70 and the flanges 35 can cooperate with one or more tribological coatings applied to the flanges 35 and/or the sleeve bearing 70.

The constant surface between the piston rod 80 and the piston 20 is designed such that this surface area between these two is greater in the direction of significant power transfer than the direction of return movement. For this reason, the sleeve bearing 70 has a contact surface area 72 on the crown 25 side of the piston 20 significantly greater than the return surface area 75. As a result of this relationship, the crown 25 has sufficient contact area to develop the power inherent in the engine incorporating same. If desired, for example to increase the tear off resistance, the contact surface area 75 can be enlarged.

In this example, the sleeve bearing 70 allows the flow of pressurized oil between a passage 81 in the piston rod 80 to the oil groove 41 thus to lubricate this critical location, a plate or dam 42 closing the bottom of the galley 45 of the crown 25 provides a reservoir for this cooling oil in the various forms noted above and herein. In another example, the mating surfaces between the sleeve bearing 70 and the piston rod 80 can cooperate with one or more tribological coatings applied to the piston rod 80 and/or the sleeve bearing 70.

The cooling oil dam or retention plate 42 is held in place proximally at the lower edge of the crown 25 by the application of a snap ring or circle ring set in a groove or by the application of the mechanical bending or folding of a segmented or non-segmented extension of the crown 25 material generally parallel to the axis of the piston rod in either the cold or warm state. In one embodiment, the cooling oil dam or retention plate 42 is held in place proximally at the lower edge of the crown 25 by the application of an interference fit between the inner and outer dimensions of said plate dam and the piston body. In another embodiment, the cooling oil dam or retention plate 42 is held in place proximally at the lower edge of the crown 25 by fixing the same in the precision casting process by casting in place. In another embodiment, the cooling oil dam or retention plate 42 is held in place proximally at the lower edge of the crown 25 by the incorporation of extending tabs on the plate that are inserted in generally segmented apertures in the lower surface of the crown 25 and rotated into a locking mode.

The piston skirts 51 completes the piston 20. Due to the dimensional stability and complexity of its associated crown 25, these skirts 51 can be of relatively simple construction. The particular piston skirt disclosed has a vertical outside surface, a center opening 52, and a lock ring access 55. The outside surface of the piston skirts 51 cooperates with the inner wall of the cylinder 100 of the engine to support the crown 25 against any tipping or angular displacement in respect to the longitudinal axis of the cylinder 100. As previously discussed, this support is provided through the outer edge 31 and the seat 32 of the crown 25.

To efficiently provide the support for the crown 25, the center opening 52 of the piston skirts 51 has two opposed flat support surfaces 53 and bearing seat 32. These together cooperate with the connecting rod flanges 35 as previously set forth to support the crown 25 against angular movement in a side wards direction (angular cocking re: the longitudinal axis 76 of the wrist pin 71).

Insofar as there are no known forces acting axially or laterally on the piston perpendicular to the axis of the piston pin below the part of the crown 25 that supports the sealing rings, all those parts of the piston usually comprising the skirt thereof regardless of material or one or two piece construction have been eliminated except for the two arcuate sections of the skirts 51.

The piston 20 further includes a cylindrical body depending from the crown 25. The cylindrical body defines at least one groove formed about the outer circumferential surface of the cylindrical body. In the illustrated embodiment, the piston includes at least two (2) compression ring grooves 40 and at least one oil control ring groove 41 formed into the outer circumferential surface. The compression ring grooves 40 are configured for use with piston sealing rings (not shown), and the oil control ring groove 41 is configured for use with an oil control ring 60 (best seen in FIG. 11). However, it should be understood by one of ordinary skill in the art that other numbers of compression ring grooves 40 and oil control ring grooves 41 in various arrangements can be formed into the outer circumferential surface 30 of the piston 20. Each of the ridges between the grooves 40, 41 can be termed a "ring land" or a "piston land."

Additionally, the oil control ring groove 41 cooperates with the oil control ring 60 to control the oil that is introduced onto the cylinder walls by lubricating oil circulating in the engine and cooling oil injected into the piston crown 25 and subsequently exiting into the engine crankcase. The oil control ring 60 scrapes the cylinder walls to return the scraped oil back toward the crankcase. One goal of the oil control ring 60 is to reduce and/or prevent oil passage between the face of the oil control ring 60 and the cylinder through the ring gap or pass behind the oil control ring 60. While not shown, the oil control ring 60 can include any number of structures, including multiple-piece rings used with an expander/spacer.

Figure 4:
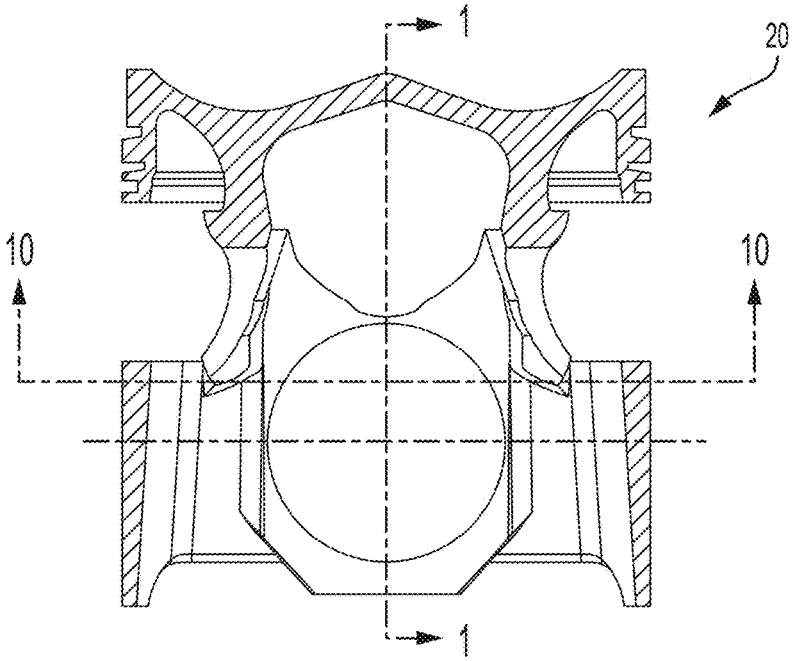
FIG. 4 is a cross-section view of the piston of FIG. 1 taken generally along line 4-4 of FIG. 2.
Figure 3:
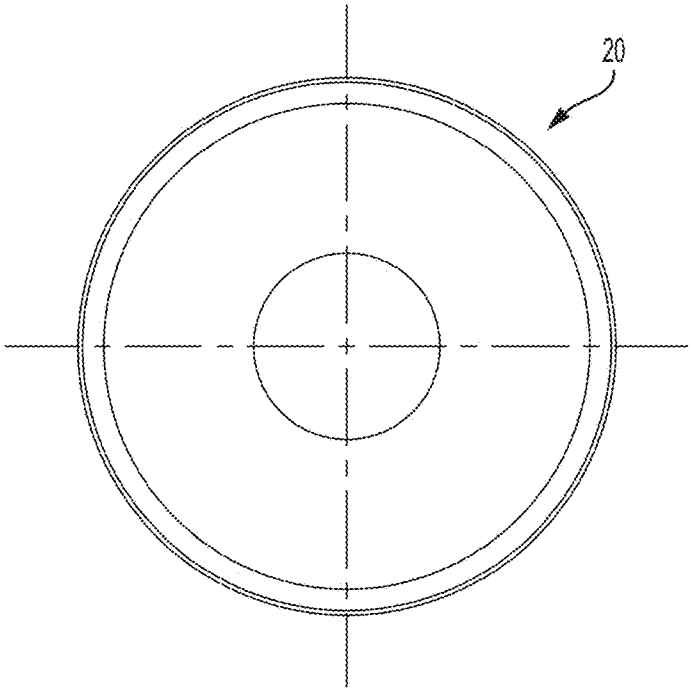
FIG. 3 is a top view of piston crown of FIG. 1.
Figure 5:
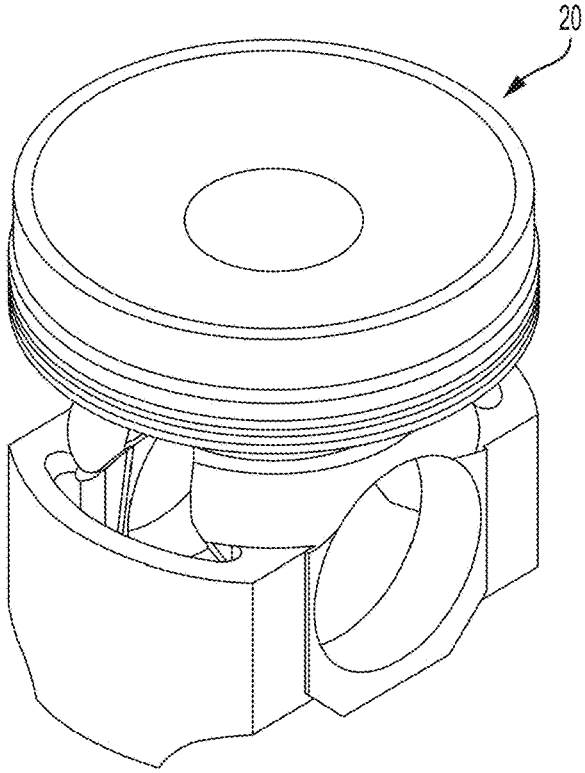
FIG. 5 is a perspective view of the piston of FIG. 1.

In one example, the piston 20 includes a truncated outer surface that forms a pair of opposing surfaces. The surfaces are formed as substantially flat portions of the outer circumferential surface of the piston, and the surfaces are substantially aligned in a parallel manner and can be equidistant from the central axis. Each surface defines a bore formed through the surface. The bore includes an axis that is perpendicular to the central axis of the piston. The bore is configured to cooperate with a connecting rod pin (not shown) for allowing the piston to be operatively connected to a connecting rod (not shown) that translates the piston within the combustion cylinder of an engine. The portions of the piston cylindrically extending between each of the opposing surfaces form the outer boundary of an integral cooling reservoir (best seen in FIG. 4).

Figure 11:
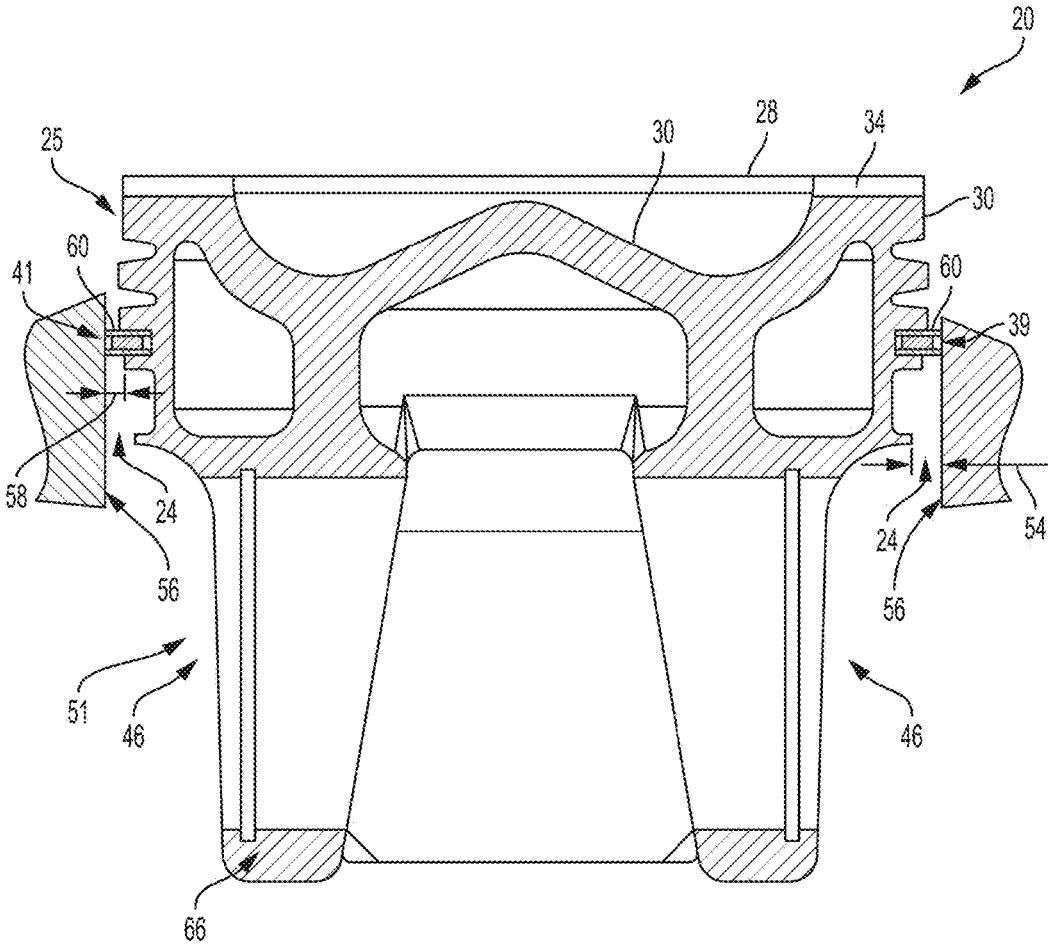
FIG. 11 is a cross-section view taken along lines 11-11 in FIG. 2.

As shown in FIG. 11, a portion of the outer surface 30 of the crown 25 defines one or more multi-arcuate, horizontal cross-sections below the oil control ring groove 41. As described above, one purpose of an oil control ring 60 is to "wipe" or remove a quantity of excess oil from an associated internal cylinder wall 56 as the piston 20 moves through a downward stroke. The oil is then returned to the other portions of the engine, which may include a crankcase and/or oil sump. The multi-arcuate, horizontal cross-section creates a passage between the cylindrical body piston 20 and the associated cylinder wall 56 of an engine, thereby enabling a quantity of oil to more easily pass from an annular region between the cylindrical body and the associated cylinder wall 56 to an area adjacent one of the pair ofconnection flanges 35. This enables the oil control ring to more efficiently accomplish its task and move and/or remove a greater quantity of oil from the cylinder wall 56 and the annular region. The same is true for the multi-arcuate horizontal cross section at each of the other locations on the piston 20, namely, the crown outside diameter, the ring lands, the piston skirts 51, etc.

Figure 6:
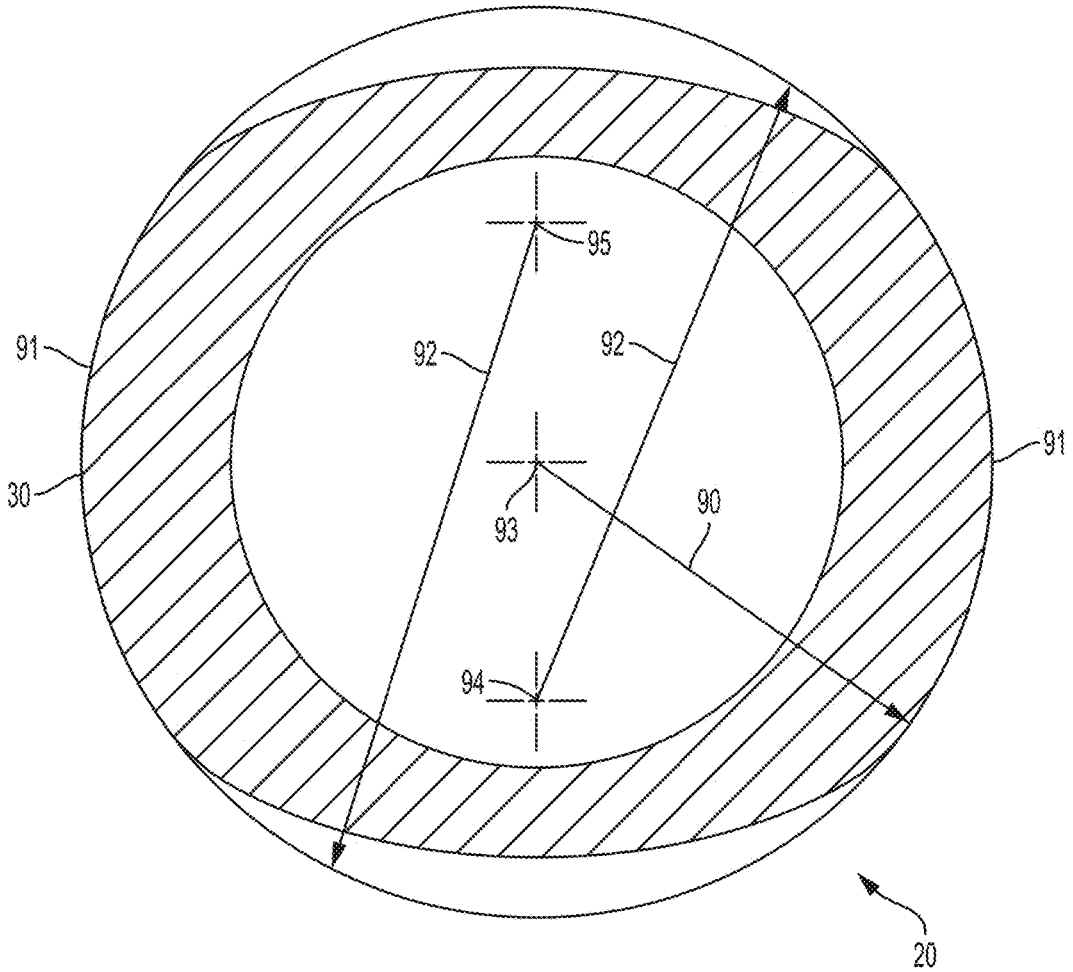
FIG. 6 is a cross-section view taken along lines 6-6 in FIG. 1.
Figure 7:
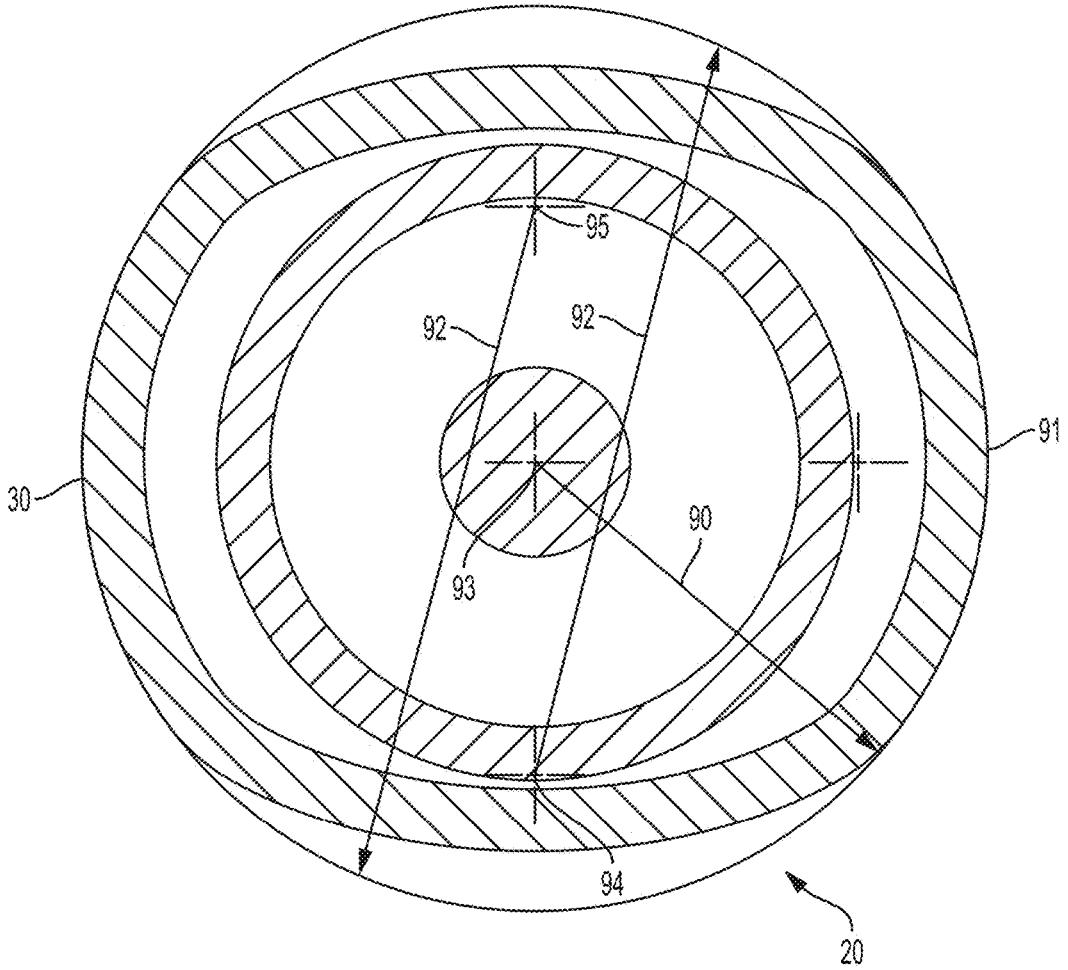
FIG. 7 is a cross-section view taken along lines 7-7 in FIG. 1.
Figure 8:
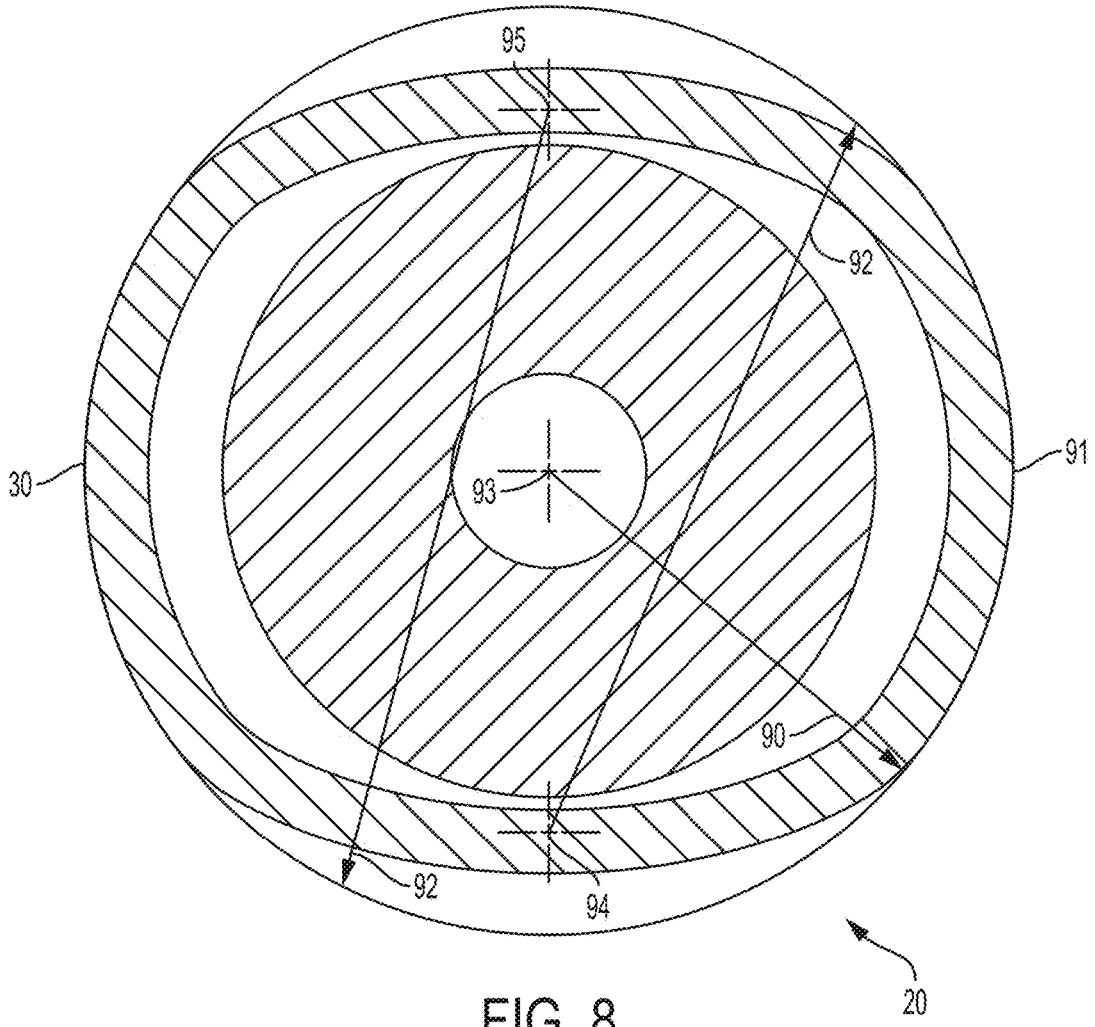
FIG. 8 is a cross-section view taken along lines 8-8 in FIG. 1.
Figure 9:
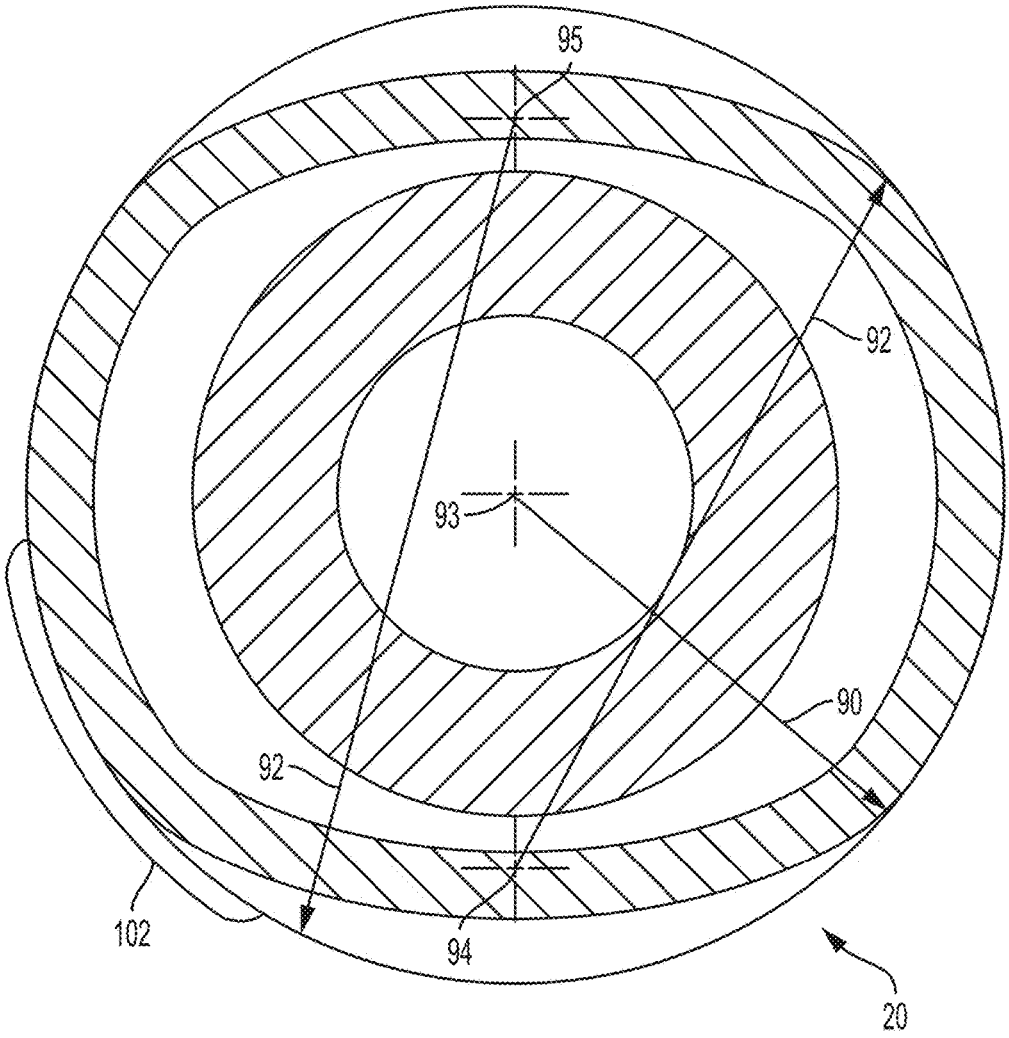
FIG. 9 is a cross-section view taken along lines 9-9 in FIG. 1.
Figure 10:
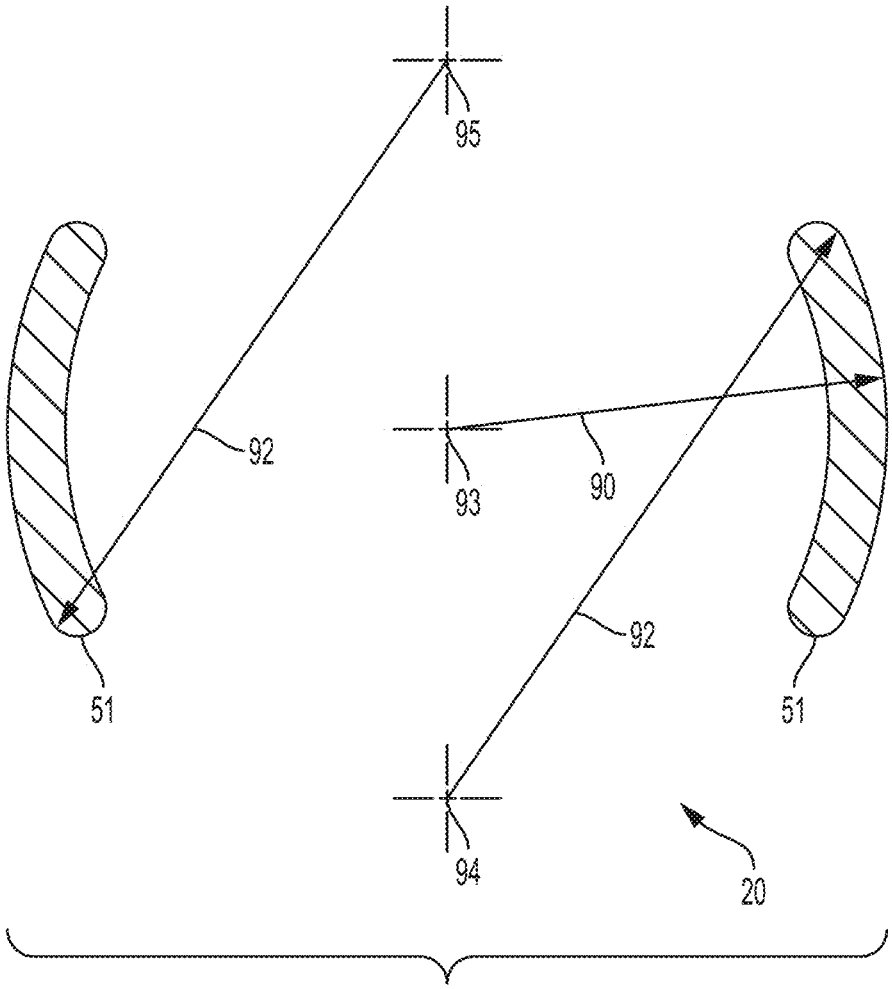
FIG. 10 is a cross-section view taken along lines 10-10 in FIG. 4.

Turning to FIG. 6, a cross-section view of the piston is shown. The multi-arcuate horizontal cross-section is shown at the crown 25 of the piston 20, below the top surface 34 and above a ring groove 40. Turning to FIG. 7, another cross-section view of the piston 20 is shown, this view taken between two of the ring grooves 40 on the ring land of the piston 20. Turning to FIG. 8, a cross-section view of the piston 20 shows the multi-arcuate horizontal cross-section between a lower ring groove 40 and the oil control ring groove 41. Turning to FIG. 9, a cross-section view of the piston 20 shows the multi-arcuate horizontal cross-section below the oil control ring groove 41. FIG. 10 shows the multi-arcuate horizontal cross-section at the skirts 51.

In the examples, as shown in FIGS. 6-10 , the multi-arcuate horizontal cross-section includes a radius 90 of the cylindrical portions 91 that is less than the radius 92 corresponding to the passage portion (e.g., 54, 58) of the multi-arcuate horizontal cross-section. In this way, the multi-arcuate horizontal cross-section is defined by four arcs of constant radius, where one pair of arcs have equal radii that are different from the equal radii of the other pair of arcs. By definition, the two pairs of circular arcs have different center points (93, 94, 95). As shown, the radius 92 defines the multi-arcuate cross-section at the top and bottom of FIGS. 6-10, while radius 90 defines the multi-arcuate cross-section to the right and left. Radius 92 is greater than radius 90, and the resulting arcs have different center points (93, 94, 95).

In another example, the multi-arcuate, horizontal cross-section is generally ovoid in shape. In other words, the perimeter of the multi-arcuate, horizontal cross-section can be a figure constructed from two pairs of arcs, with two different radii. The arcs are joined at a point, in which lines tangential to both joining arcs lie on the same line, thus making the joint smooth. Any point on the ovoid perimeter belongs to an arc with a constant radius (shorter or longer). In another example, multi-arcuate, horizontal cross-section can be defined by a series of intersecting arcs. In yet another example, the multi-arcuate horizontal cross section can include elliptical portions, hyperbolic portions, parabolic portions, or even some straight lines. It is to be understood that other cross-section shapes and/or other similar shapes are also contemplated, so long as the horizontal cross-sectional shape creates the described passage between the piston 20 and the associated cylinder wall 56 of the engine one example (e.g., 54, 58) shown in FIG. 11.

Also, by precision casting to net final dimensions, additional machining to form the any of the surfaces of the integral cooling oil reservoir is eliminated. In an embodiment, precision casting to net final dimensions of the upper and lower members means that the precision as-cast dimensional tolerance is between about +/−0.010 inches to about +/−0.020 inches. In another embodiment, precision casting to net final dimensions of the upper and lower members means that certain surfaces include a surface finish roughness of less than about 125 Ra.

In one example, returning to FIG. 9, at least one tribological coating 102 is applied to at least one the exterior and /or interior of the surfaces of the piston including the bearing seats 32 in lieu of including the bushing 70 to form a bearing surface. The coating can be any suitable tribological coating or coatings including, but not limited to, manganese phosphates, manganese iron phosphates, zinc phosphates, tin compounds, polycrystalline diamond, diamond-like coatings, ceramics, etc. In one example, the at least one tribological coating has a thickness of less than about 6 μm. In another example, the at least one tribological coating has a thickness of greater than about 18 μm. In one example, the at least one tribological coating can have a grain size of less than about 10 μm. In another example, the at least one tribological coating has a grain size of greater than about 50 μm.

Alternatively, or additionally, a tribological coating 102 can be applied to an exterior surface of the pin. The at least one tribological coating 102 can have the same thickness and grain size parameters as the at least one tribological coating 102 applied to the cylindrical surface.

Applying the at least one tribological coating 102 to the pin and/or the cylindrical surface of the bore can have several benefits. First, a tribological coating such as manganese phosphate can improve the wear resistance of the wear surfaces of the piston components. This often enables piston and engine parts to have a longer expected service life, and help reduce decreasing performance characteristics over time, thereby maintaining required operational and long-term durable performance. The at least one tribological coating can also retain oil and lubricants, thereby improving a scuffing resistance of the piston. Furthermore, tribological coatings can offer improved corrosion resistance, again helping to improve piston and engine service life.

While this disclosure has been written in conjunction with the specific embodiments described above, it is evident that many alternatives, combinations, modifications and variations are apparent to those skilled in the art. Accordingly, the described embodiments of this disclosure, as set forth above are intended to be illustrative only, and not in a limiting sense. Various changes can be made without departing from the spirit and scope of this disclosure. Combinations of the above embodiments and other embodiments will be apparent to those of skill in the art upon studying the above description and are intended to be embraced therein. Therefore, the scope of the present disclosure is defined by the appended claims, and all devices, processes, and methods that come within the meaning of the claims, either literally or by equivalence, are intended to be embraced therein. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A piston designed for reciprocatable movement within a combustion chamber of an internal combustion engine, said piston comprising:

a piston crown with an integrally cast piston skirt comprising two equal and opposing arcuate surfaces each of which comprises an arc of less than 180 degrees with the centerline of each arcuate section perpendicular to the axis of the connecting rod connecting pin bore;

two integrally cast connecting rod connecting flanges all of which are precision cast of high-strength ferrous material net to finished dimensions on all inner and outer surfaces to provide a defined thickness throughout to ensure mechanical and thermal consistency with only secondary finishing of an outer cylindrical surface of the crown, outer edges of the connecting rod flanges, two connecting rod bearing surfaces, and a top surface of the crown, while eliminating machining operations necessary to achieve constant and correct cross sectional dimensions of the crown and the piston skirt; and a cooling oil dam that is positioned adjacent a lower edge of the crown and attachable to the crown by an interference fit, wherein each operative part of the crown comprises a substantially constant thickness throughout as initially precision cast to net finished dimensions, wherein a portion of the piston defines at least one multi-arcuate horizontal cross-section, wherein the multi-arcuate horizontal cross-section includes arcs including different radii, wherein the crown defines a ring groove and an oil groove on an exterior surface, and wherein the piston further comprises an oil control ring groove below the ring groove and a ring land between the oil control ring groove and the ring groove, wherein the multi-arcuate horizontal cross-section is defined by the ring land between the oil control ring groove and the ring groove.

2. The piston of claim 1, wherein the connecting rod flanges extend dependingly from an inner surface of the crown, each of the connecting rod flanges having a lower end, each of the rod flanges being either tapered from the inner surface of the crown to a reduced section at the lower end, or parallel to the axis of a connecting rod.

3. The piston of claim 1, wherein the crown has a circumferentially interrupted lower surface, and the piston skirts comprise two equal and directly opposing arcuate skirt sections parallel to the vertical axis of the piston, each of the sections include a defined thickness throughout to ensure mechanical and thermal consistency, and to ensure consistent contact with the cooperating cylinder wall surfaces.

4. The piston of claim 1, wherein the multi-arcuate horizontal cross-section is defined by an exterior surface of the piston crown above the ring groove.

5. The piston of claim 1, wherein the piston further comprises a ring land between one or more of the ring grooves and the multi-arcuate horizontal cross-section is defined by an exterior surface of the ring land.

6. The piston of claim 1, wherein the multi-arcuate horizontal cross-section is defined by the piston skirt.

7. A piston designed for reciprocatable movement within a combustion chamber of an internal combustion engine comprising:

a piston crown with an integrally cast piston skirt comprising two equal and opposing arcuate surfaces each of which comprises an arc of less than 180 degrees with the centerline of each arcuate section perpendicular to the axis of the connecting rod connecting pin bore; and two integrally cast connecting rod connecting flanges extending between the arcuate surfaces each of which are precision cast of high-strength ferrous material net to finished dimensions on all inner and outer surfaces to provide a controlled thickness throughout to ensure mechanical and thermal consistency with only secondary finishing of an outer cylindrical surface of the crown, outer edges of the rod connecting flanges, a rod connection bearing seat, and a top surface of the crown, while eliminating machining operations necessary to achieve constant and correct cross sectional dimensions of the crown and the piston skirt;

wherein each operative part of the crown comprises a substantially constant thickness throughout as initially precision cast to net finished dimensions, wherein a portion of the piston defines at least one multi-arcuate horizontal cross-section, wherein the multi-arcuate horizontal cross-section includes arcs including different radii, wherein the piston skirt is configured to ensure consistent contact with the cooperating cylinder wall surfaces, and wherein the piston further comprises an oil control ring groove below the ring groove and a ring land between the oil control ring groove and the ring groove, wherein the multi-arcuate horizontal cross-section is defined by the ring land between the oil control ring groove and the ring groove.

8. The piston of claim 7, wherein the multi-arcuate horizontal cross-section is defined by an exterior surface of the piston crown above the ring groove.

9. The piston of claim 7, wherein the piston further comprises a ring land between one or more of the ring grooves and the multi-arcuate horizontal cross-section is defined by an exterior surface of the ring land.

10. The piston of claim 7, wherein the multi-arcuate horizontal cross-section is defined by the piston skirt.

11. A piston designed for reciprocatable movement within a combustion chamber of an internal combustion engine comprising:

a piston crown with an integrally cast piston skirt and two rod connecting flanges precision cast of high-strength ferrous material net to finished dimensions on all inner and outer surfaces to provide a controlled thickness throughout to ensure mechanical and thermal consistency with only secondary finishing of an outer cylindrical surface of the crown, outer edges of the rod connecting flanges, a rod connection bearing seat, and a top surface of the crown, while eliminating machining operations necessary to achieve constant and correct cross sectional dimensions of the crown and the piston skirt, and wherein each of the rod connecting flanges includes a center opening formed therethrough to provide a contact surface that is generally cylindrical, wherein the surface area of an upper half of the contact surface that is closer to the crown is greater than the surface area of a lower half of the contact surface that is farther from the crown, wherein a portion of the piston defines at least one multi-arcuate horizontal cross-section, wherein the multi-arcuate horizontal cross-section includes arcs including different radii, wherein each operative part of the crown comprises a substantially defined thickness throughout as initially precision cast to net finished dimensions, and wherein the piston further comprises an oil control ring groove below the ring groove and a ring land between the oil control ring groove and the ring groove, wherein the multi-arcuate horizontal cross-section is defined by the ring land between the oil control ring groove and the ring groove.

12. The piston of claim 11, wherein the multi-arcuate horizontal cross-section is defined by an exterior surface of the piston crown above the ring groove.

13. The piston of claim 11, wherein the piston further comprises a ring land between one or more of the ring grooves and the multi-arcuate horizontal cross-section is defined by an exterior surface of the ring land.

14. The piston of claim 11, wherein the multi-arcuate horizontal cross-section is defined by the piston skirt.

* * * * *